US010561218B2

(12) United States Patent
Huang

(10) Patent No.: US 10,561,218 B2
(45) Date of Patent: Feb. 18, 2020

(54) LIGHT CURING DEVICE

(71) Applicant: QUAN MEI TECHNOLOGY CO., LTD., Kaohsiung (TW)

(72) Inventor: Kuo-Hsien Huang, Tainan (TW)

(73) Assignee: QUAN MEI TECHNOLOGY CO., LTD., Kaohsiung (TW)

( * ) Notice: Subject to any disclaimer, the term of this patent is extended or adjusted under 35 U.S.C. 154(b) by 648 days.

(21) Appl. No.: 15/233,350

(22) Filed: Aug. 10, 2016

(65) Prior Publication Data

US 2017/0127790 A1 May 11, 2017

(30) Foreign Application Priority Data

Nov. 5, 2015 (TW) ..... 104217715 U

(51) Int. Cl.
*A45D 29/00* (2006.01)
*B05D 3/06* (2006.01)

(52) U.S. Cl.
CPC ..... *A45D 29/00* (2013.01); *B05D 3/067* (2013.01)

(58) Field of Classification Search
CPC ..... A45D 29/00; A45D 29/18; B05D 3/067; F26B 3/28; F26B 9/003
See application file for complete search history.

(56) References Cited

U.S. PATENT DOCUMENTS

2008/0170039 A1* 7/2008 Shin ..... G09F 9/33 345/170
2011/0277338 A1* 11/2011 Li ..... F26B 3/28 34/275

* cited by examiner

*Primary Examiner* — David E Smith
*Assistant Examiner* — Hsien C Tsai
(74) *Attorney, Agent, or Firm* — Muncy, Geissler, Olds & Lowe, P.C.

(57) ABSTRACT

A light curing device includes a housing module and a lighting module. The lighting module includes a light emitter, a driver and a switch module. The light emitter includes a plurality of light-emitting elements configured to emit curing light into an irradiation space in the housing module. The driver is for driving the light-emitting elements, and includes a plurality of user-operable setting buttons corresponding to at least one of the light-emitting elements. When triggered, the switch module is operable to activate the driver to drive at least one of the light-emitting elements that corresponds to a selected one of the user-operable setting buttons to emit the curing light.

18 Claims, 6 Drawing Sheets

LIGHT CURING DEVICE

CROSS-REFERENCE TO RELATED APPLICATION

This application claims priority of Taiwanese Patent Application No. 104217715, filed on Nov. 5, 2015.

FIELD

The disclosure relates to a light coring device, and more particularly to a light curing device capable of emitting ultraviolet light with various wavelengths.

BACKGROUND

A conventional light curing device is adapted to emit light on a hand or foot of a user applied with a light curable product, such as gel nail polish. The conventional light curing device however lacks an indicator for showing duration of the light curing process or state of the conventional light curing device, such as whether or not the device is activated. Furthermore, the conventional light curing device is not capable of emitting curing light with different wavelengths for different types of the gel nail polish or for different thicknesses of the gel nail polish applied to nails.

SUMMARY

Therefore, an object of the disclosure is to provide a light curing device that can alleviate at least one of the drawbacks of the prior art.

According to the disclosure, the light curing device includes a housing module and a lighting module.

The housing module defines an irradiation, space.

The lighting module is disposed at the housing module, and includes a light emitter, a driver and a switch module.

The light emitter includes light-emitting elements configured to be driven to emit curing light into the irradiation space.

The driver is electrically connected to the light-emitting elements for driving the light-emitting elements, and includes user-operable setting buttons. The user-operable setting buttons are disposed on and exposed from the housing module. Each of the user-operable setting buttons corresponds to at least one of the light-emitting elements.

The switch, module is operable to activate the driver when triggered by an object placed in the irradiation space.

When the driver is activated and a selected one of the user-operable setting buttons is operated, the driver is operable to drive at least one of the light-emitting elements that corresponds to the selected one of the user-operable setting buttons to emit the curing light.

BRIEF DESCRIPTION OF THE DRAWINGS

Other features and advantages of the disclosure will become apparent, in the following detailed description of the embodiments with reference to the accompanying drawing, of which.

DETAILED DESCRIPTION

Figure 1:
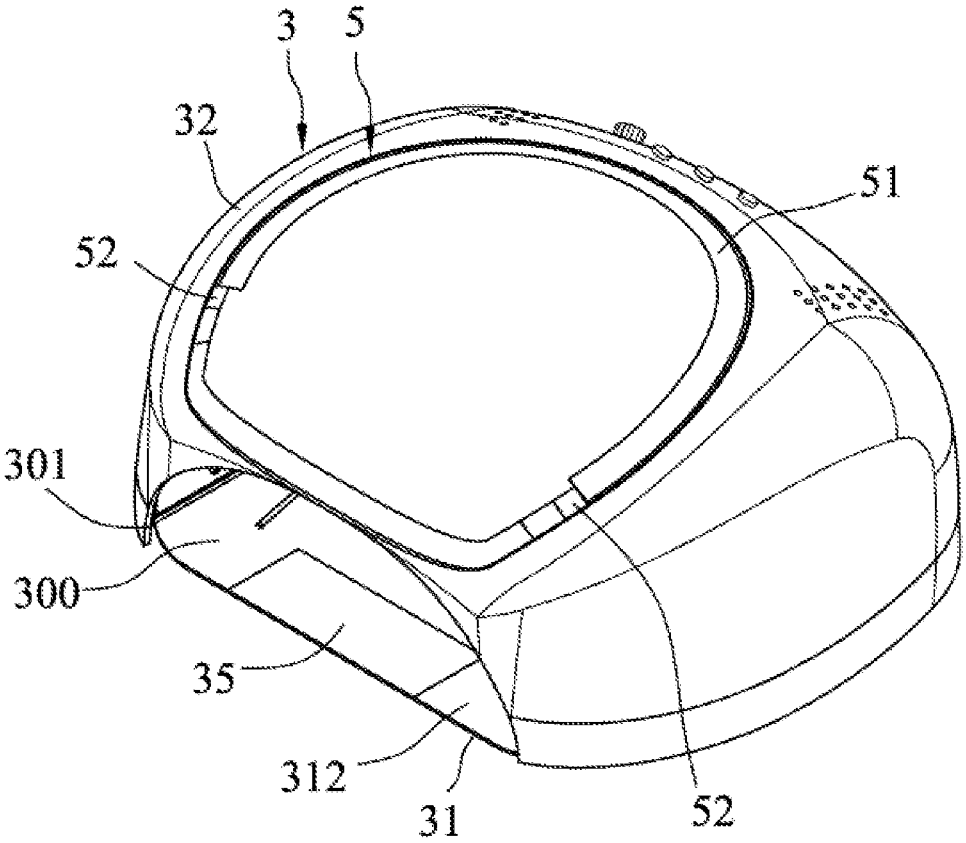
FIG. 1 is a perspective view of a first embodiment of a light, curing device according to the disclosure.
Figure 2:
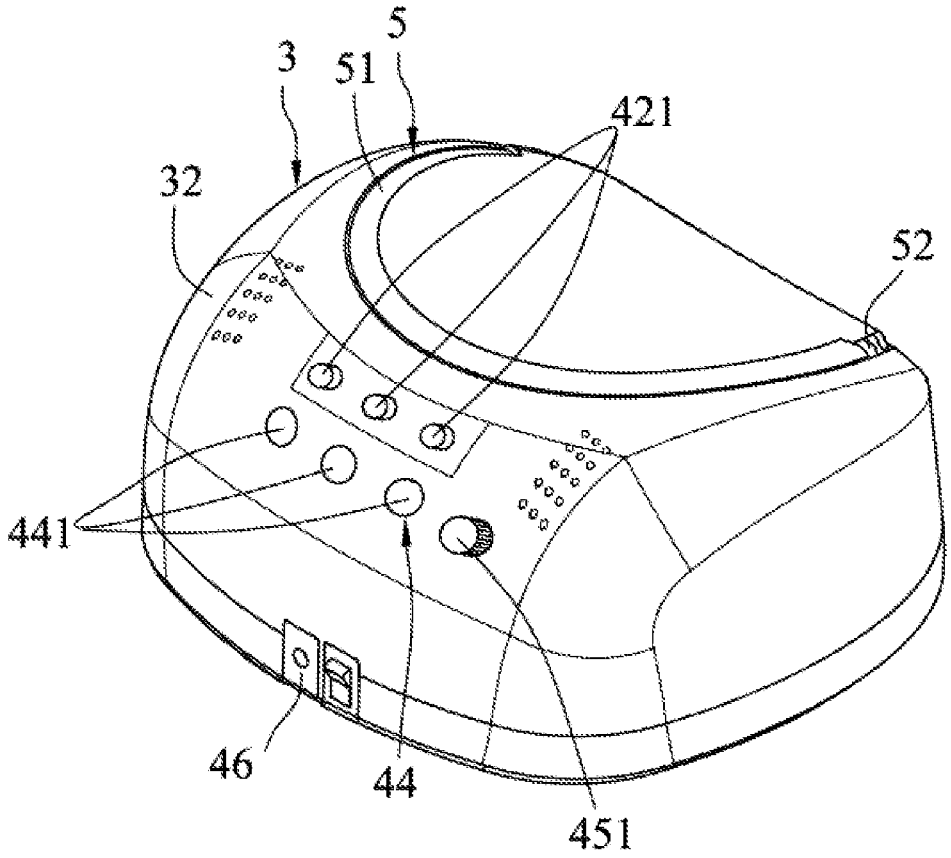
FIG. 2 is a perspective view of the first embodiment of the light curing device according to the disclosure from another viewpoint.
Figure 3:
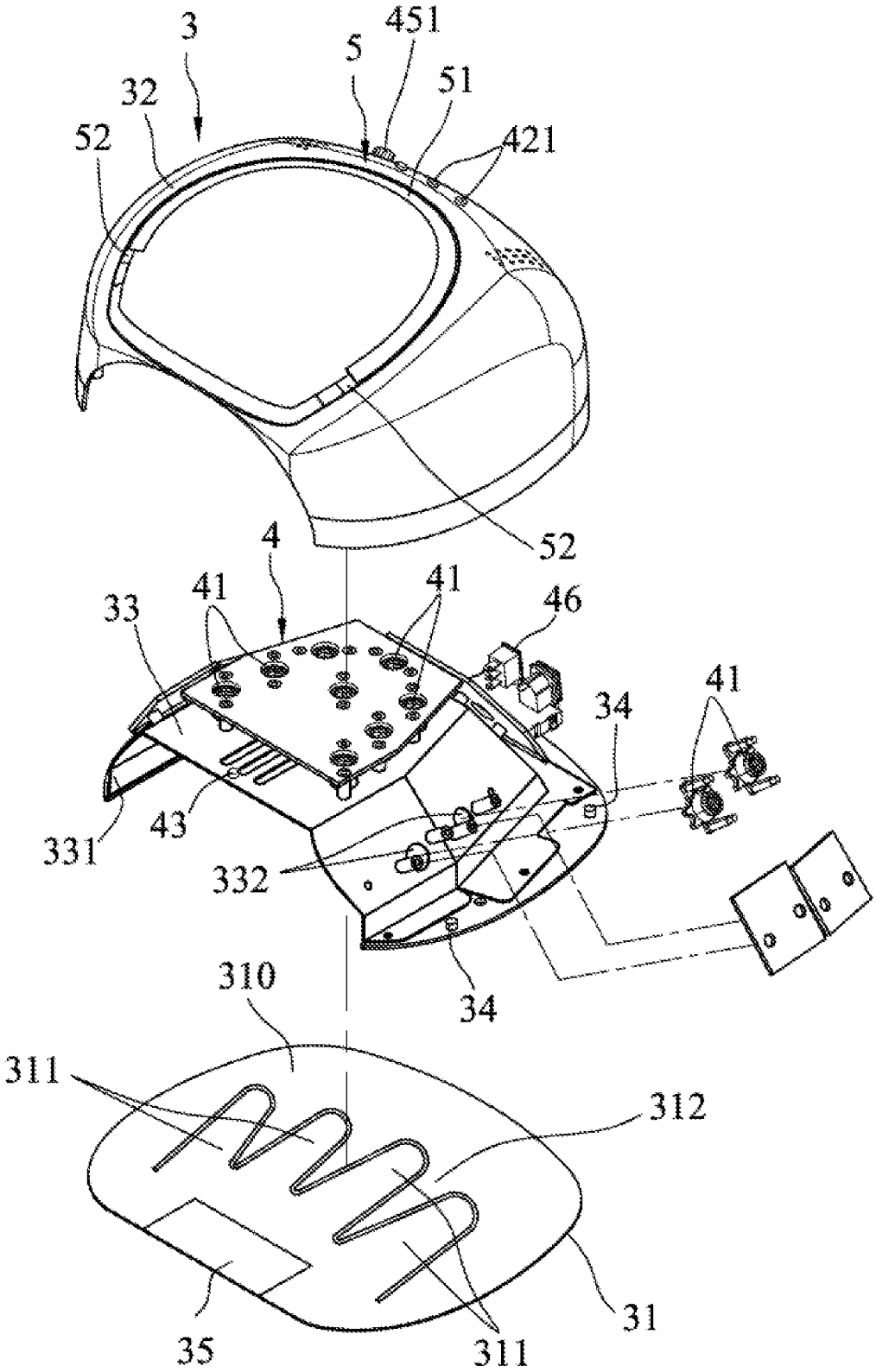
FIG. 3 is an exploded perspective view of the first embodiment of the light curing device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, the first embodiment of a light caring device according to this disclosure is described below. The light curing device includes a housing module 3, a lighting module 4 and an indicator module 5.

The housing module 3 includes a base plate 31, an outer cover 32, an inner cover 33, and a plurality of magnetic members 34 disposed at the inner cover 33 for interconnecting the inner cover 33 and the base plate 31. The outer cover 32 covers the inner cover 33 and the base plate 31 separably, is coupled to the base plate 31 separably, and cooperates with the inner cover 33 and the base plate 31 to define an irradiation space 300 and an opening 301. The opening 301 is in spatial communication with the irradiation space 300, and is configured to permit insertion of an object (e.g., a user's hand or foot) therethrough into the irradiation space 300. The base plate 31 is formed with a plurality of grooves 311 for positioning of fingers or toes of the user. In this embodiment, the grooves 311 are substantially finger-shaped. The user can insert his/her hand into the irradiation space 300 with the fingers positioned about the grooves 311. The base plate 31 has a top surface 310. The top surface 310 has a reflective zone 312 surrounding the grooves 311 and capable of reflecting curing light emitted by the lighting module 4. The inner cover 33 is formed with a plurality of mounting holes 332, and has an inner reflective surface 331 that faces the base plate 31 and that is capable of reflecting the curing light. The tops surface 310 further has an anti-reflecting zone that does not reflect light, In an embodiment, the housing module 3 further includes an anti-reflecting membrane 35 attached to the top surface 310 of the base plate 31 for serving as the anti-reflecting zone. As illustrated in FIG. 1, the anti-reflecting membrane 35 is disposed near the opening 301, and significantly reduces the reflection of the curing light.

Referring to FIGS. 2 to 5, the lighting module 4 is disposed at the housing module 3, and includes a plurality of light emitters 41, a driver 42, a switch module 43, a timer 44, a pulse width modulator 45 and a power terminal 46.

In this embodiment, each of the light emitters 41 includes two light-emitting elements 411, and each of the light-emitting elements 411 is an ultraviolet (UV) light-emitting diode (LED). The light emitters 41 are disposed at the housing module 3 between the outer cover 32 and the inner cover 33, and are configured to emit the curing light into the irradiation space 300. In particular, the light emitters 41 are disposed respectively in the mounting holes 332 in the inner cover 33. In this embodiment, the light-emitting elements 411 of each of the light emitters 41 are configured to emit the curing light having different wavelengths, respectively. In this embodiment, the curing light emitted from the light-emitting elements 411 is ultraviolet (UV) light having the wavelengths in a range from 365 nm to 430 nm.

The switch module 43 is operable to activate the driver 42 when triggered by the object placed in the irradiation space 300. In this embodiment, the switch module 43 is a reflective optical sensor module including an optical emitter 432 and an optical sensor 431 that are arranged side by side. The optical emitter 432 is electrically connected to the driver 42, and is configured to emit sensing light toward a predetermined area within the irradiation space 300. The optical sensor 431 is capable of sensing reflected sensing light, which is the sensing light reflected by and due to presence of the object at the predetermined area within the irradiation space 300. The optical sensor 431 is also configured to activate the driver 42, the timer 44 and the pulse width modulator 45 whenever the reflected sensing light is sensed thereby. In this embodiment, the switch module 43 is disposed at the inner cover 33, is exposed in the irradiation space 300, and is positioned above the anti-reflecting membrane 35. Essentially, the anti-reflecting membrane 35 serves as the predetermined area, and the switch module 43 emits the sensing light towards the anti-reflecting membrane 35. In the absence of the object, the switch module 43 will not receive reflected sensing light, so the switch module 43 is not triggered, When the object, such as the user's hand, is placed on the anti-reflecting membrane 35 and reflects the sensing light, the switch module 43 will receive the reflected sensing light and is triggered to activate the driver 42, the timer 44 and the pulse width modulator 45.

The timer 44 is electrically connected to the switch module 43 and the driver 42, and has a plurality of timing configurations defining different time durations (e.g., 10 seconds, 20 seconds, or 30 seconds), respectively. The timer 44 includes a plurality of time-setting buttons 441 disposed on and exposed from an outer surface of the outer cover 32 and corresponding to the timing configurations, respectively. When the timer 44 is activated by the switch module 43 and a selected one of the time-setting buttons 441 is operated, the timer 44 is operable to start timing one of the time durations defined by a corresponding one of the timing configurations that corresponds to the selected one of the time-setting buttons 441, and to output an activating signal. Then, the timer 44 is further operable to output a deactivating signal while the one of the time durations has elapsed.

The driver 42 is electrically connected to the light emitters 41, the switch module 43, the timer 44 and the pulse width modulator 45. The driver 42 includes a plurality of user-operable setting buttons 421 that are disposed on and exposed from the outer surface of the outer cover 32. Each of the user-operable setting buttons 421 corresponds to at least one of the wavelengths. When the driver 42 is activated and a selected one of the user-operable setting buttons 421 is operated, the driver 42 is operable to drive at least one of the light-emitting elements 411 to emit the curing light having one of the wavelengths corresponding to the selected one of the user-operable setting buttons 421 while the driver is triggered by the activating signal. The driver 42 is further operable to stop driving the light-emitting elements 411 to emit the curing light when triggered by the deactivating signal.

For example, when one of the user-operable setting buttons 421 that corresponds to a particular wavelength is operated, the driver 42 only drives one of the light-emitting elements 411 of each of the light emitters 41 to emit the UV light having the particular wavelength to serve as the curing light. In another case, when one of the user-operable setting buttons 421 that corresponds to two different, wavelengths is operated, the driver 42 drives the light-emitting elements 411 of each of the light emitters 41 to emit the UV light having the two different wavelengths to serve as the curing light. In this case, the light emitters 41 emit the curing light having the two different wavelengths.

The pulse width modulator 45 is configured to generate and output a pulse width modulation signal to the driver 42 for controlling the driver 42 to supply current intermittently to the light-emitting elements 411 for driving the light-emitting elements 411 when the driver 42 is activated. The pulse width modulator 45 includes a user-operable adjusting mechanism 451 disposed at the outer cover 32 of the housing module 3. The user-operable adjusting mechanism 451 is operable for changing a duty cycle of the pulse width modulation signal by operating the user-operable adjusting mechanism 451, so as to vary the intermittent supply of the current by the driver 42 according to the changing duty cycle. More specifically, the driver 42 supplies the current to drive the light-emitting elements 411 to emit the curing light, when the pulse width modulation signal is active (on), and the driver 42 does not supply the current and thus the light-emitting element 411 does not emit the curing light when the pulse width modulation signal is inactive (off).

In one embodiment of this disclosure, the user-operable adjusting mechanism 451 is omitted, and the pulse width modulator 45 is configured to generate the pulse width modulation signal with a predetermined fixed duty cycle. In other embodiments, the pulse width modulator 45 may be configured to generate the pulse width modulation signal with varying duty cycle. With either configuration, the intermittent, irradiation of the curing light on the user's hand/foot alleviates the burning, pricking or tingling sensation felt by the user.

The indicator module 5 is coupled to the lighting module 4, and includes a light guide 51, two indicating light sources 52 and an indicator controller 53. The light guide 51 is made of material that, can guide light, and is exposed from the outer surface of the outer cover 32. The indicating light sources 52 are configured to emit indicating light toward the light guide 51, such that the indicating light can be seen from outside of the housing module 3. The indicator controller 53 is activated and driven by the switch module 43 to emit the indicating light with a specific color to indicate a stand-by state of the light curing device. When activated, the indicator controller 53 is triggered by the activating signal from the timer 44 to control and drive the indicating light sources 52 to emit the indicating light having different colors respectively corresponding to the time durations, and is further triggered by the deactivating signal from the timer 44 to stop the indicating light, sources 52 from emitting the indicating light. It should be noted that the color of the indicating light is used to indicate which one of the tinting configurations is in operation.

In this embodiment, the driver 42, the timer 44 and the pulse width modulator 45 are integrated into a circuit board 600.

Figure 4:
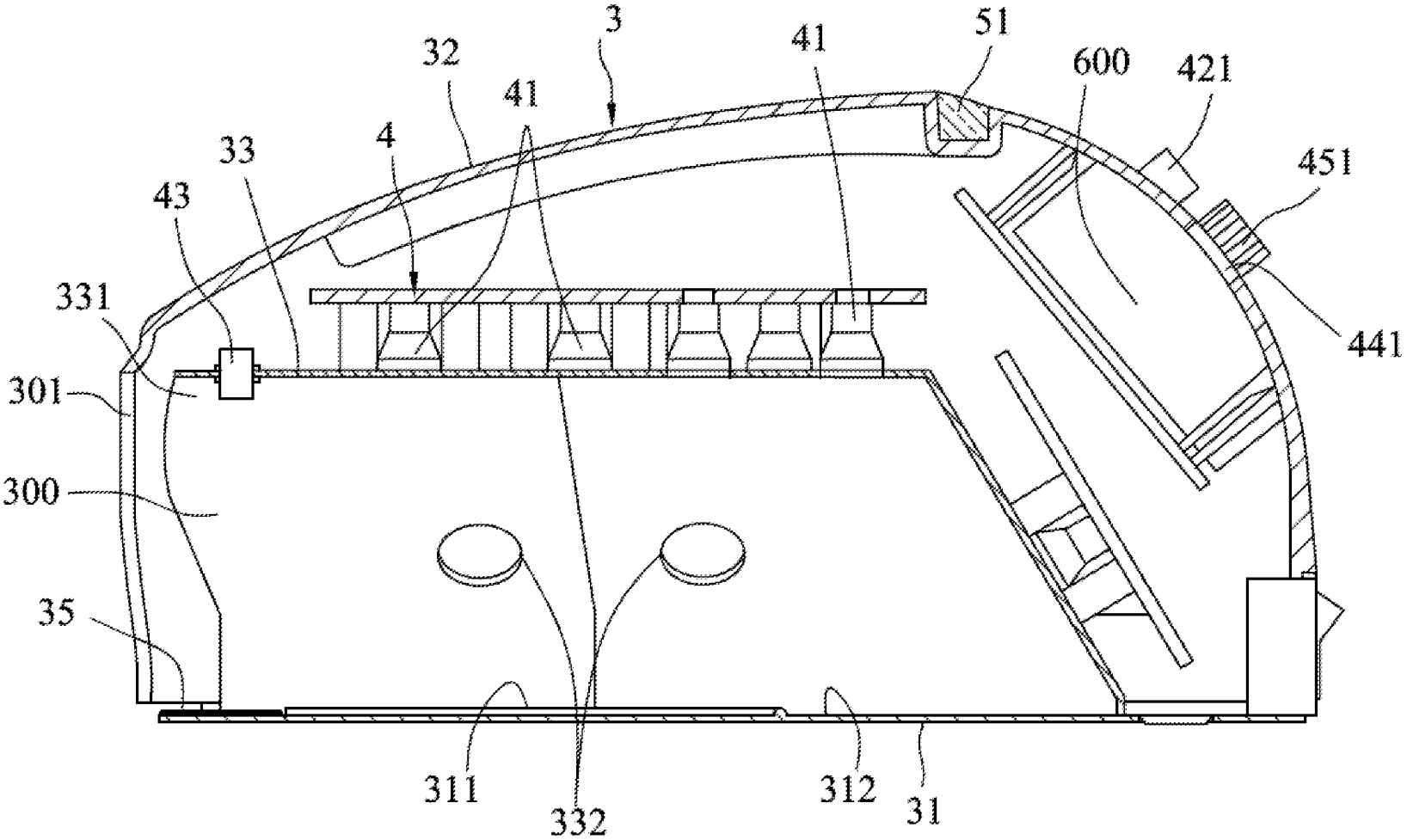
FIG. 4 is a cross-sectional view of the first embodiment of the light curing device according to the disclosure.
Figure 5:
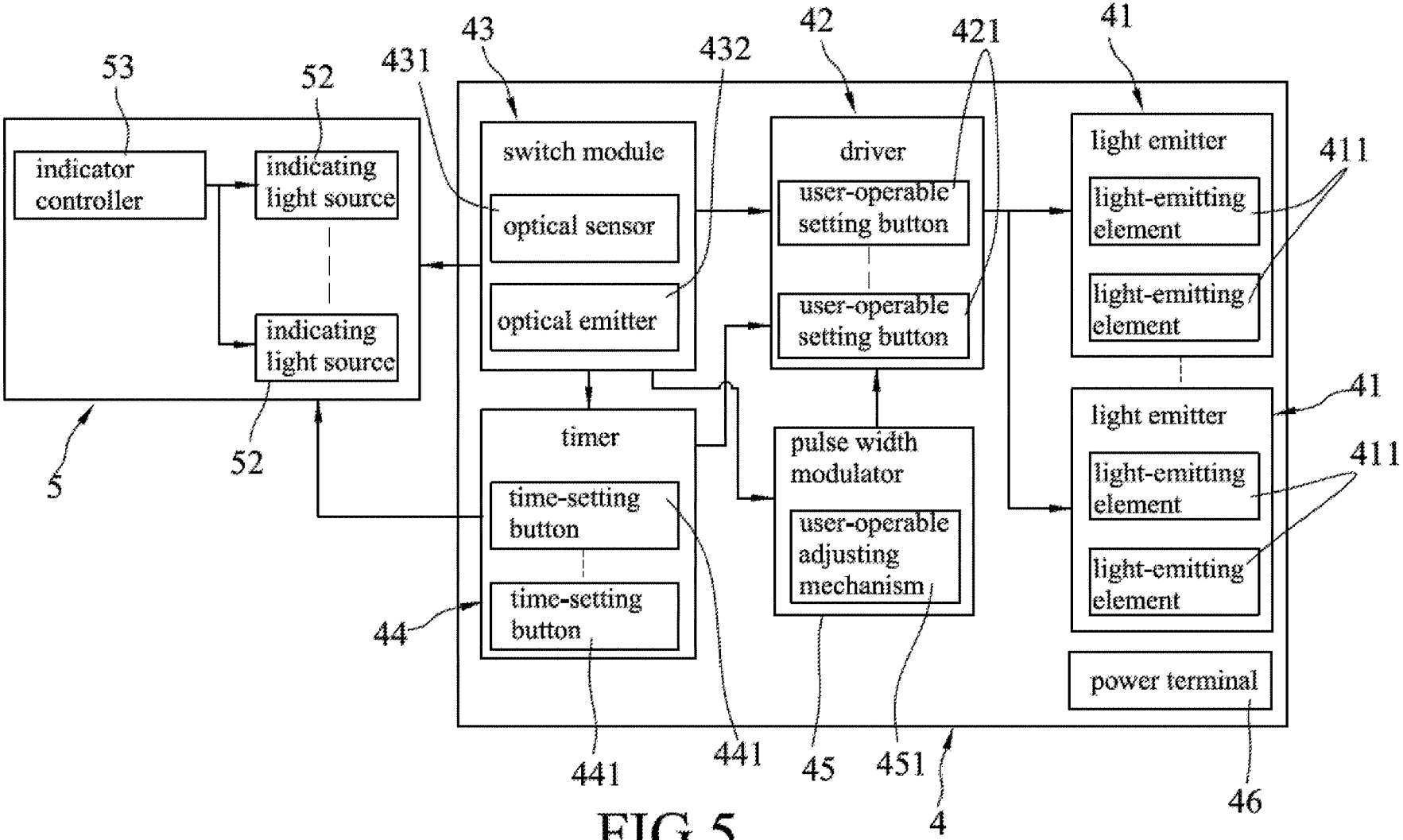
FIG. 5 is a block diagram for illustrating electronic components of the first embodiment of the light curing device according to the disclosure.

Referring to FIGS. 1, 4, and 5, as an example, for gel nail polish curing purposes, the user inserts his/her fingers or toes applied with gel nail polish into the irradiation space 300 through the opening 301 and places the fingers or toes about the grooves 311. At this time the switch module 43 senses the reflected sensing light reflected by the user's hand or foot, and activates the driver 42, the timer 44, the pulse width modulator 45 and the indicator module 5 to operate.

At this time, the light guide 51 of the indicator module 5 emits the indicating light with the specific color to indicate that the light curing device is in the stand-by state.

Then, the user can select, and operate one of the user-operable setting buttons 421 and operate the user-operable adjusting mechanism 451, so that the light emitters 41 emit the curing light with the proper wavelength and pulse width for curing the gel nail polish. Next, the user can select and operate one of the time-setting buttons 441 to select one of the time durations of curing process of the gel nail polish. At this time, the timer 44 outputs the activating signal to activate the driver to drive the light emitters 41 to emit the curing light. At the same time, the pulse width modulator 45 controls the driver 42 to drive the light-emitting elements 411 to intermittently emit the curing light. Before the selected one of the time durations has elapsed, the user may freely remove the fingers or toes from the irradiation space 300, such that the switch module 43 is not triggered and disables the driver 42 so as to cease the emission of the curing light by the light-emitting elements 411.

In addition, once the selected one of the time durations has elapsed, the deactivating signal is outputted to trigger the driver 42 to stop driving the light-emitting elements 411 to emit the curing light.

It should be noted that, since the reflective surface 331 of the inner cover 33 and the reflective zone 312 on the top surface 310 of the base plate 31 both can reflect light, the curing light emitted by the lighting module 4 is irradiated evenly in the irradiation space 300.

In this embodiment, the timer 44 includes three time-setting buttons 441 corresponding respectively to three timing configurations, and the indicator module 5 can emit the indicating light with four different colors to respectively indicate the stand-by state and the timing configurations. In one embodiment, each of the time durations is divided into a plurality of successive periods, and the timer 44 is operable to output timing signals respectively at the periods, and the indicator controller 53 is not only configured to be triggered by the activating signal but also to be triggered by the timing signals to gradually adjust brightness of the indicating light emitted by the indicating light sources 52, such as to make the indicating light gradually brighten or gradually fade, for indicating progress of the curing process of the gel nail polish.

In one embodiment, the indicator controller 53 is triggered sequentially by the timing signals from the timer 44 so as to control and drive the indicating light source 52 to emit the indicating light with different colors respectively at the periods for indicating the progress of the curing process.

In one embodiment, the indicator module 5 includes a plurality of the light guides 51 and a plurality of the indicating light sources 52. A number of the light guides 51 and a number of the indicating light sources 52 are equal to a number of the periods of each of the time durations. The indicator controller 53 is triggered sequentially by the timing signals from the timer 44 so as to control and drive the indicating light sources 52 to start emitting the indicating light one by one. Alternatively, the indicator controller 53 drives all the indicating light sources 52 to start emitting the indicating light at a beginning of the time duration, and is triggered sequentially by the timing signals to disable the indicating light sources 52 one by one.

It should be noted that, since the base plate 31 is separable from the inner cover 33, in use, the user may choose to place the fingers or toes on a surface (such as a tabletop), separate the base plate 31 from the light, curing device, and cover the fingers or toes with the remainder of the light curing device. Alternatively, the user may place his/her hand or foot on the base plate 31 first, and then assemble the remainder of the light curing device with the base plate 31.

In one embodiment, the light-emitting elements 411 are configured to emit the curing light having the same wavelength. The user-operable setting buttons 421 correspond to different integers, respectively. When a selected one of the user-operable setting buttons 421 is operated, the driver 42 is operable to drive a number of the light-emitting elements 411 of each of the light emitters to emit the curing light, and the number of the light-emitting elements 411 of the light emitters is equal to the integer (i.e. one or two) corresponding to the selected one of the user-operable setting buttons 421. That is to say, when the user-operable setting button 421 that corresponds to two is operated, two of the light-emitting elements 411 of each of the light emitters 41 are driven to emit, the curing light at the same time. When the user-operable setting button 421 that corresponds to one is operated, only one of the light-emitting elements 411 of each of the light emitters 41 is driven to emit the curing light. As a result, the brightness of the curing light can be adjusted. In one embodiment, the number of the light-emitting elements 411 of each of the light emitters 41 is more than two.

Figure 6:
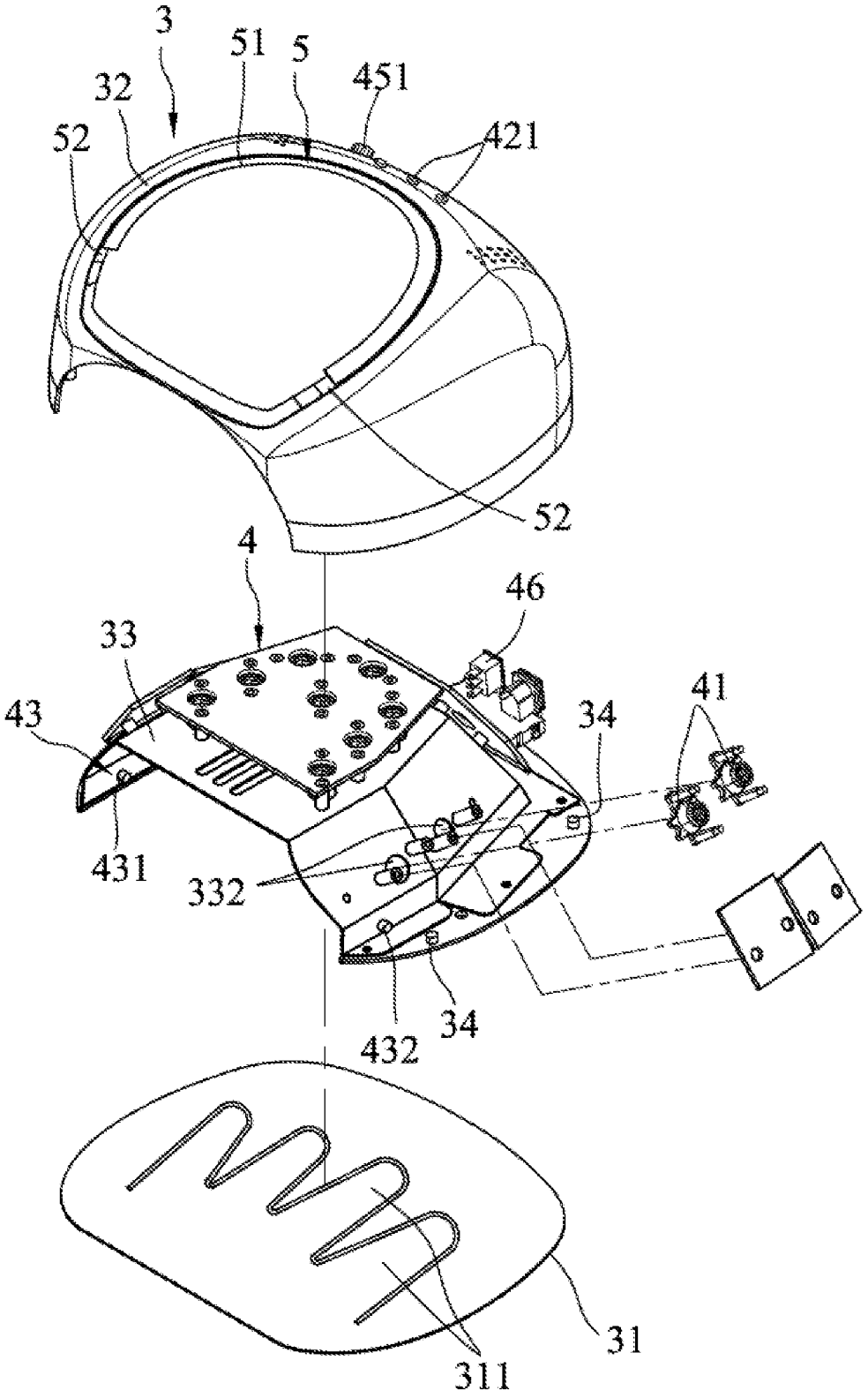
FIG. 6 is an exploded perspective view illustrating a second embodiment of a light curing device according to the disclosure.

Referring to FIGS. 5 and 6, a second embodiment of a light curing device according to this disclosure is described below. The second embodiment differs from the first embodiment mainly in the switch module 43. The switch module 43 is an optical sensor module, and includes an optical emitter 432 and an optical sensor 431. The optical emitter 432 is configured to emit the sensing light, and the optical sensor 431 is configured to receive the sensing light from the optical emitter 432 and to activate the driver 42 whenever not receiving the sensing light. The optical emitter 432 and the optical sensor 431 are respectively disposed on left and right sides of the inner cover 33, and the optical emitter 432 is configured to continuously emit the sensing light toward the optical sensor 431. When the object in the irradiation space 300 between the optical sensor 431 and the optical emitter 432 blocks the sensing light, the optical sensor 431 does not receive the sensing light, and the switch module 43 is triggered and activates the driver 42, the timer 44, the pulse width modulator 45 and the indicator module 5.

In one embodiment, the switch module 43 is a microswitch that is configured to be triggered upon being touched by the object in the irradiation space 300, and to activate the driver 42 whenever the microswitch is triggered. The description of the other similar structure and operation will be omitted for the sake of brevity.

In one embodiment, the switch module 43 is mounted co-movably to the base plate 31 and has a first terminal (not shown) fixed at the base plate 31, and the lighting module 4 has a second terminal (not shown) disposed, at the outer cover 32 or the inner cover 33 and configured to be electrically and separably connected to the first terminal so as to electrically connect the switch module 43 to the driver 42 of the lighting module 4. Similarly, in one embodiment, the optical sensor 431 and the optical emitter 432 are mounted respectively co-movably to the base plate 31 and the inner cover 33, and are configured to be electrically and separably connected to the first terminal and the second terminal so as to electrically connect the switch module 43 to the driver 42 of the lighting module 4.

In summary, the user can adjust the wavelength and/or the brightness of the curing light by operating the user-operable setting buttons 421, the time-setting buttons 441, and the user-operable adjusting mechanism 451 according to demand. In addition, the color of the indicating light emitted by the indicator module 5 can indicate the stand-by state and/or the timing configurations, so the user can be informed clearly of operation status of the light curing device according to this disclosure.

Furthermore, the user can prevent the hand from feeling a burning sensation by adjusting the user-operable adjusting mechanism 451. The light-emitting element 411 automatically turns off after the timer 44 finishes counting or the switch module 43 senses no hand or foot in the light curing device, such as the hand or the foot pulling out of the light curing device. Thus, nervousness of the user will be decreased and safety will be increased.

In the description above, for the purposes of explanation, numerous specific details have been set forth in order to provide a thorough understanding of the embodiments. It will be apparent, however, to one skilled In the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be Included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A light curing device comprising:

a housing module defining an irradiation space; and a lighting module disposed at said housing module, and including a light emitter including at least two light-emitting elements that are configured to be driven to emit curing light into the irradiation space, a driver electrically connected to said light-emitting elements for driving said light-emitting elements, and including a plurality of user-operable setting buttons that are disposed on and exposed from said housing module, each of said user-operable setting buttons corresponding to at least one of said light-emitting elements, and a switch module operable to activate said driver when triggered by an object placed in the irradiation space, wherein, when said driver is activated and a selected one of said user-operable setting buttons is operated, said driver is operable to drive at least one of said light-emitting elements that corresponds to the selected one of said user-operable setting buttons to emit the curing light, wherein said lighting module further includes a timer electrically connected to said switch module and said driver, having a plurality of timing configurations that respectively define different time durations, and including a plurality of time-setting buttons that are disposed on and exposed from said housing module and that correspond to the timing configurations, respectively, wherein, when said timer is activated by said switch module and a selected one of said time-setting buttons is operated, said timer is operable to output an activating signal, and to output a deactivating signal when one of the time durations defined by a corresponding one of the timing configurations that corresponds to the selected one of said time-setting buttons has elapsed, wherein said driver is configured to drive at least one of said light-emitting elements to emit the curing light when triggered by the activating signal, and to stop driving said light-emitting elements to emit the curing light when triggered by the deactivating signal, and wherein the light curing device further comprises an indicator module coupled to said lighting module, and including a light guide that is exposed from said housing module, an indicating light source that is configured to emit indicating light toward said light guide, and an indicator controller that is configured to be triggered by the activating signal from said timer, and to control and drive said indicating light source to emit the indicating light having different colors respectively corresponding to the time durations.

2. The light curing device as claimed in claim 1, wherein said light-emitting elements are configured to emit the curing light having different wavelengths, respectively, wherein each of said user-operable setting buttons corresponds to at least one of the wavelengths, wherein, when said driver is activated and the selected one of said user-operable setting buttons is operated, said driver is operable to drive at least one of said light-emitting elements to emit the curing light having one of the wavelengths corresponding to the selected one of said user-operable setting buttons.

3. The light curing device as claimed in claim 1, wherein said light-emitting elements are configured to emit the curing light having the same wavelength, wherein said user-operable setting buttons correspond to different integers, respectively, wherein, when the selected one of said user-operable setting buttons is operated, said driver is operable to drive a number of said light-emitting elements of each of said light emitters, the number of said light-emitting elements of each of said light emitters being equal to the integer corresponding to the selected one of said user-operable setting buttons.

4. The light curing device as claimed in claim 1, wherein, when triggered by the object placed in the irradiation space, said switch module is further operable to activate said indicator controller to control and drive said indicating light source to emit the indicating light with a specific color to indicate a stand-by state of said light curing device.

5. The light curing device as claimed in claim 1, wherein each of the time durations is divided into a plurality of successive periods, and said timer is further operable to output timing signals respectively at the periods, wherein said indicator controller is further configured to be triggered sequentially by the timing signals from said timer so as to gradually adjust brightness of the indicating light emitted by said indicating light source.

6. The light curing device as claimed in claim 1, wherein each of the time durations is divided into a plurality of successive periods, and said timer is further operable to output timing signals respectively at the periods, wherein said indicator controller is further configured to be triggered sequentially by the timing signals from said timer so as to control and drive said indicating light source to emit the indicating light with different colors at the periods, respectively.

7. The light curing device as claimed in claim 1, wherein said indicator module includes a plurality of said light guides, and a plurality of said indicating light sources configured to emit indicating lights toward said light guides, respectively, wherein each of the time durations is divided into a plurality of successive periods, and said timer is further operable to output timing signals respectively at the periods, wherein said indicator controller is further configured to be triggered sequentially by the timing signals from said timer so as to control and drive said indicating light sources to emit the indicating light one by one.

8. The light curing device as claimed in claim 1, wherein said switch module is an optical sensor module, and includes an optical emitter for emitting sensing light, and an optical sensor that is configured to receive the sensing light from said optical emitter and to activate said driver whenever not receiving the sensing light.

9. The light curing device as claimed in claim 1, wherein said switch module is a reflective optical sensor module, and includes:

an optical emitter that is electrically connected to said driver and that is configured to emit sensing light toward the irradiation space; and an optical sensor that is capable of sensing reflected sensing light, which is the sensing light reflected by and due to presence of the object in the irradiation space, and that is configured to activate said driver whenever the reflected sensing light is sensed thereby.

10. The light curing device as claimed in claim 9, wherein said housing module includes a base plate, an anti-reflecting membrane attached to a top surface of said base plate, an inner cover disposed on said base plate and having an inner reflective surface that faces said base plate for reflecting the curing light, and an outer cover covering said inner cover and said base plate and cooperating with said inner cover and said base plate to define the irradiation space and an opening that is in spatial communication with the irradiation space and that is configured to permit insertion of the object therethrough into the irradiation space, wherein said switch module is disposed on said inner cover and is configured to emit the sensing light toward said anti-reflecting membrane.

11. The light curing device as claimed in claim 1, wherein said switch module is a microswitch that is configured to be triggered upon being touched by the object in the irradiation space, and to activate said driver whenever said microswitch is triggered.

12. The light curing device as claimed in claim 1, wherein said housing module includes a base plate, and a cover covering and coupled to said base plate, and cooperating with said base plate to define the irradiation space and an opening that is in spatial communication with the irradiation space and that is configured to permit insertion of the object therethrough into the irradiation space, wherein said switch module is disposed on at least one of said cover and said base plate.

13. The light curing device as claimed in claim 12, wherein the object is one of a hand and a foot, and said base plate is formed with a plurality of grooves for positioning of fingers or toes.

14. The light curing device as claimed in claim 12, wherein said switch module is mounted co-movably to said base plate.

15. The light curing device as claimed in claim 14, wherein said cover is coupled to said base plate separably, and said housing module further includes at least one magnetic member disposed on said cover for interconnecting said cover and said base plate.

16. The light curing device as claimed in claim 1, wherein said lighting module further includes a pulse width modulator that is electrically connected to said driver, and that is configured to output a pulse width modulation signal to said driver for controlling said driver to supply current intermittently to said light-emitting elements for driving said light-emitting elements when said driver is activated.

17. The light curing device as claimed in claim 16, wherein said pulse width modulator includes a user-operable adjusting mechanism disposed at said housing module, and operable for changing a duty cycle of the pulse width modulation signal.

18. The light curing device as claimed in claim 16, wherein said pulse width modulator is configured to generate the pulse width modulation signal with a varying duty cycle.

* * * * *